US009385491B1

(12) United States Patent
Peng

(10) Patent No.: US 9,385,491 B1
(45) Date of Patent: Jul. 5, 2016

(54) OVERHEAT AUTO POWER OFF SOCKET

(71) Applicant: ZENTECH ELECTRONICS CO., LTD., Taipei (TW)

(72) Inventor: Kuo-Ching Peng, Taipei (TW)

(73) Assignee: Zentech Electronics Co., Ltd., Taipei (TW)

( * ) Notice: Subject to any disclaimer, the term of this patent is extended or adjusted under 35 U.S.C. 154(b) by 0 days.

(21) Appl. No.: 14/836,764

(22) Filed: Aug. 26, 2015

(51) Int. Cl.
*H01R 13/66* (2006.01)
*H01R 13/713* (2006.01)

(52) U.S. Cl.
CPC ..... *H01R 13/7137* (2013.01)

(58) Field of Classification Search
CPC .. H01R 9/2425; H01R 9/2433; H01R 9/2441; H01R 13/66; H01R 13/68
USPC ..... 439/620.21
See application file for complete search history.

(56) References Cited

U.S. PATENT DOCUMENTS 8,708,758 B2 * 4/2014 Peng ..... H01R 13/18 439/822
8,926,352 B2 * 1/2015 Wang ..... H01R 12/57 439/250
9,052,100 B2 * 6/2015 Blackstone ..... F21V 23/026
2003/0236010 A1 * 12/2003 Gorman ..... H01R 31/065 439/107
2004/0221181 A1 * 11/2004 Yu ..... G06F 1/266 713/300
2006/0054339 A1 * 3/2006 Domeyer ..... H01R 4/242 174/53
2009/0093163 A1 * 4/2009 Tsai ..... H01R 13/502 439/620.21
2011/0300754 A1 * 12/2011 Kim ..... H01R 13/506 439/620.21
2013/0225013 A1 * 8/2013 Peng ..... H01R 13/18 439/729
2014/0160741 A1 * 6/2014 Blackstone ..... F21V 23/026 362/221
2015/0338443 A1 * 11/2015 Rohr ..... H01R 9/2425 324/127

* cited by examiner

*Primary Examiner* — Abdullah Riyami
*Assistant Examiner* — Nader Alhawamdeh
(74) *Attorney, Agent, or Firm* — Schmeiser, Olsen & Watts, LLP

(57) ABSTRACT

The present invention relates to an overheat auto power off socket, in which a linkage unit it includes is positioned at one side of a conductive shrapnel, and via a hot melt piece found within linkage unit, it conducts electricity, and when the temperature level of the conductive shrapnel is too high, it first melts, and then causes formation of a short circuit between linkage unit and the wiring terminal frame, so that it stops conduction of electricity, and therefore achieves the purpose of preventing formation of dangerous situations due to high temperatures.

4 Claims, 6 Drawing Sheets

OVERHEAT AUTO POWER OFF SOCKET

FIELD OF THE INVENTION

The present invention relates to a power off device, and particularly relates to an overheat auto power off socket, which can prevent overheating by automatically interrupting the power supply in case of an overheating situation.

BACKGROUND OF THE INVENTION

Electricity is supplied to conventional electrical devices after they are connected to a socket through a plug and form an electrical connection, so that the electrical devices can operate. If high temperature conditions occur in common electrical devices due to consuming relatively large amount of power or use for a long time etc. reasons, these devices may have overheating protection systems installed, so that these devices would be protected against burning down by means of these protection systems. Moreover, all of the indoor power networks are connected to a circuit breaker (also known as power master switch) that would perform on-off controls. In case the amount of electric current is larger than the preset value, the system would automatically form a short circuit or a fuse would be installed within the circuit breaker, so that when the amount of electric current is larger than the preset value, the fuse would blow out and thus open a circuit to form a short circuit and protect the electric circuit from getting damaged.

The electric wires that catch fire are one of the reasons leading to fire disasters in old-fashioned buildings, and the most common situation in which the electric wires catch fire is the case wherein the circuit is old and has low load capacity and thus become overloaded. When the electric current surpasses the ampere-capacity of the electric wire, the heat energy of the core wire exceeds the heat energy that can be carried, and if it reaches above the allowed electric current, it would possibly ignite the surroundings or cause a spark. If there is a flammable substance, for instance a blanket, window curtains, wallpapers etc., around the electric wire, these materials can easily catch fire and burn, and as a result, cause serious casualties.

Since the rate of aging for circuits are not same, usually, the circuit found within the socket that contacts with air most frequently is the one that gets old quickest. The lower electric current capacity of the circuit that gets old and the preset circuit capacity may not be the same, and therefore after the circuit gets old to a certain degree, the preset electric current throughput of the fuse found on the circuit breaker would be greater than the electric current throughput that the old circuit can carry. As a result, the fuse can not respond when the old circuit is overloaded, and thus the electric wire catches fire.

SUMMARY OF THE INVENTION

The present invention aims to overcome the drawbacks of the prior art, such that when an overheating situation occurs in an electric wire (in other words, the temperature rises above the preset value), it would be activated to form a short circuit and thus stop the supply of power to that socket, so that it would prevent occurrence of a fire accident, and in this way, overcome the prior art problem of not being able to respond directly to the practical circuit situation.

In order to achieve above said purposes, the present invention relates to an overheat auto power off socket, which comprises a cover, a box body, a socket frame, an elastic socket frame, a linkage unit, and a wiring terminal frame.

A predetermined number of jacks are positioned on the cover. The box body comprises an open slot, wherein the top surface of said open slot can be suitably covered by said cover, and several wire guides pass through the lower side of said open slot. A socket groove that matches up to the jacks provided on said cover is positioned on one end of each socket frame, a wiring terminal is positioned on the other end, and said wiring terminal is positioned in a way that it would correspond to the position of the wire guide. A plug-in slot is positioned on the elastic socket frame, a conductive shrapnel is positioned a side edge of said plug-in slot, and said conductive shrapnel would be deformed and displaced, when compressed. A linkage unit is positioned at the side edge of said conductive shrapnel, and said linkage unit comprises a connecting conductive shrapnel and a hot melt piece. One side of said hot melt piece is connected to said connecting conductive shrapnel, and the other side of said hot melt piece be pushed by the conductive shrapnel of the elastic socket frame. Moreover, the melting point of said hot melt piece is lower than the melting points of said connecting conductive shrapnel and said conductive shrapnel. A connection block protrudes from one end of a wiring terminal frame. Said connection block is found near said connecting conductive shrapnel, and a protruding connection piece extends on said connection block opposite to said conductive shrapnel piece. A wiring terminal is positioned on the other end of said wiring terminal frame, and said wiring terminal is positioned close to the position of the wire guide.

The present invention provides an overheat auto power off socket, in which, when a plug is inserted into the socket groove of said socket frame and the plug-in slot of said elastic socket frame, the plug pushes the conductive shrapnel to be displaced outward, and thus causes the conductive shrapnel push against said hot melt piece, and thus said hot melt piece also pushes said connecting conductive shrapnel, so that said connecting conductive shrapnel and said connection block come into contact and form a circuit. If the amount of electric current passing through this circuit exceeds the carrying capacity of the circuit, the temperatures of the connecting conductive shrapnel and the conductive shrapnel also rise and thus cause the hot melt piece that has relatively low melting point melt firstly and deform, and when the width of the hot melt piece narrows down due to deformation, the amount of displacement provided by the push of the hot melt piece is reduced, and thus contact is lost between said connecting conductive shrapnel and the connection block, or in other words, a short circuit is formed between said linkage unit and said wiring terminal frame, so that the continuous distribution of the electric current stops and the purpose of preventing the problem of catching fire due to continuous rise of temperature is achieved.

DETAILED DESCRIPTION OF THE PREFERRED EMBODIMENTS

Figure 1:
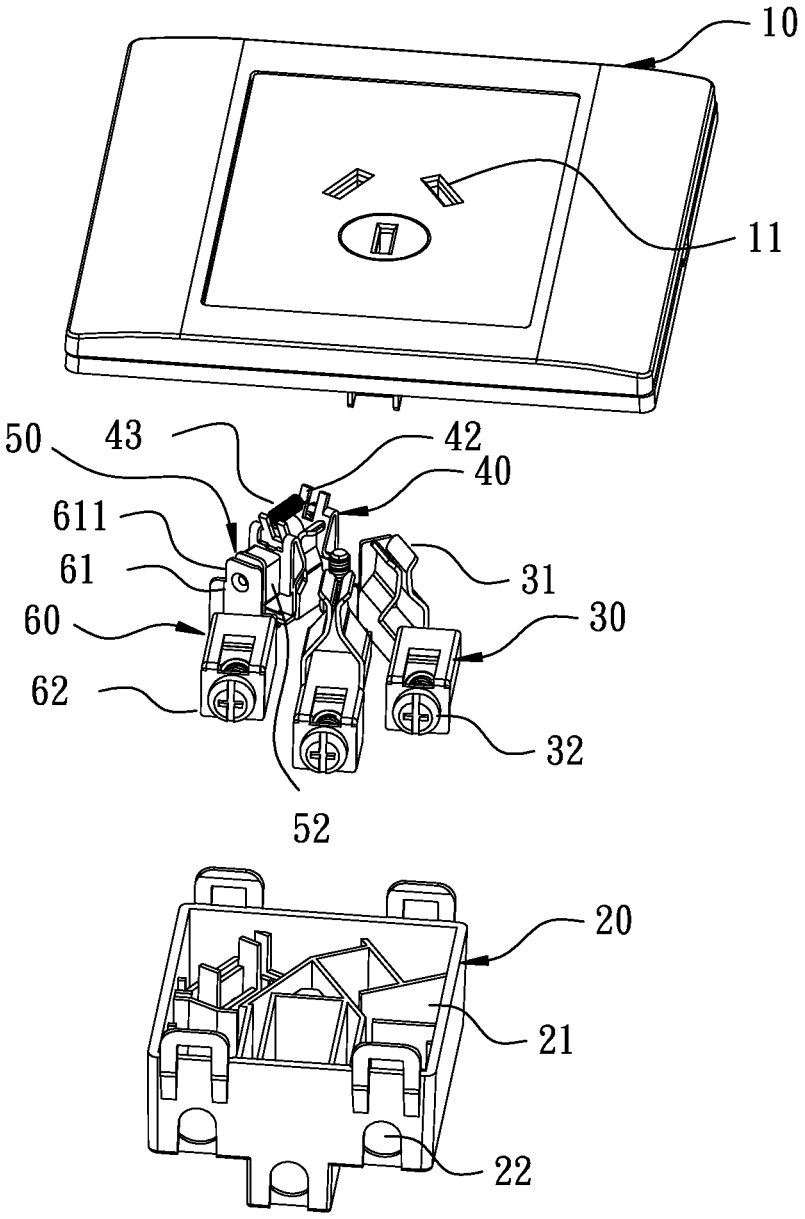
FIG. 1 is a three dimensional exploded view of the present embodiment.

In FIG. 1, a three dimensional exploded view of an overheat auto power off socket is shown, wherein said overheat auto power off socket comprises a cover (10), a box body (20), two socket frames (30), an elastic socket frame (40), a linkage unit (50), and a wiring terminal frame (60).

Two of the above said jacks (11) can be placed on said cover (10). For example, three of them are shown in the figure.

Figure 2:
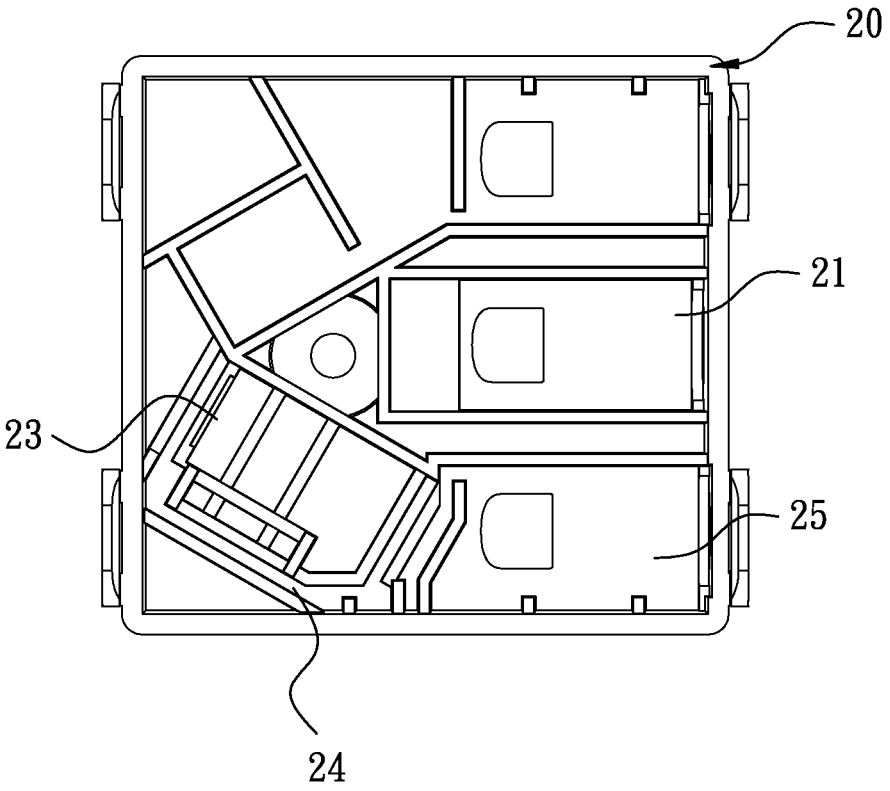
FIG. 2 is a top view of the box body according to the present embodiment.

In FIG. 2, said box body (20) is the top view of the box body according to the present embodiment. The box body comprises an open slot (21). A cover (10) can be provided to cover the top surface of said open slot (21). Three wire guides (22) are positioned at the lower side of said open slot (21). Said wire guides (22) are used to insert power cables (not shown) through. At the bottom surface of said box body (20) a first displacement limiting slot (23), a second displacement limiting slot (24), and a third displacement limiting slot (25) are positioned.

A socket groove (31) is positioned at one end of a socket frame (30). The socket groove (31) and the jacks (11) provided on said cover (10) match up to each other. A wiring terminal (32) is positioned at the other end of the socket frame (30). The wiring terminal (32) is positioned close to the wire guide (22) position, so that each wiring terminal (32) can be connected a power cable (not shown). Besides, the shape or the number of the socket frames (30) may vary in different regions, and therefore it is not restricted with this embodiment, which is given for illustrative purposes.

Figure 3:
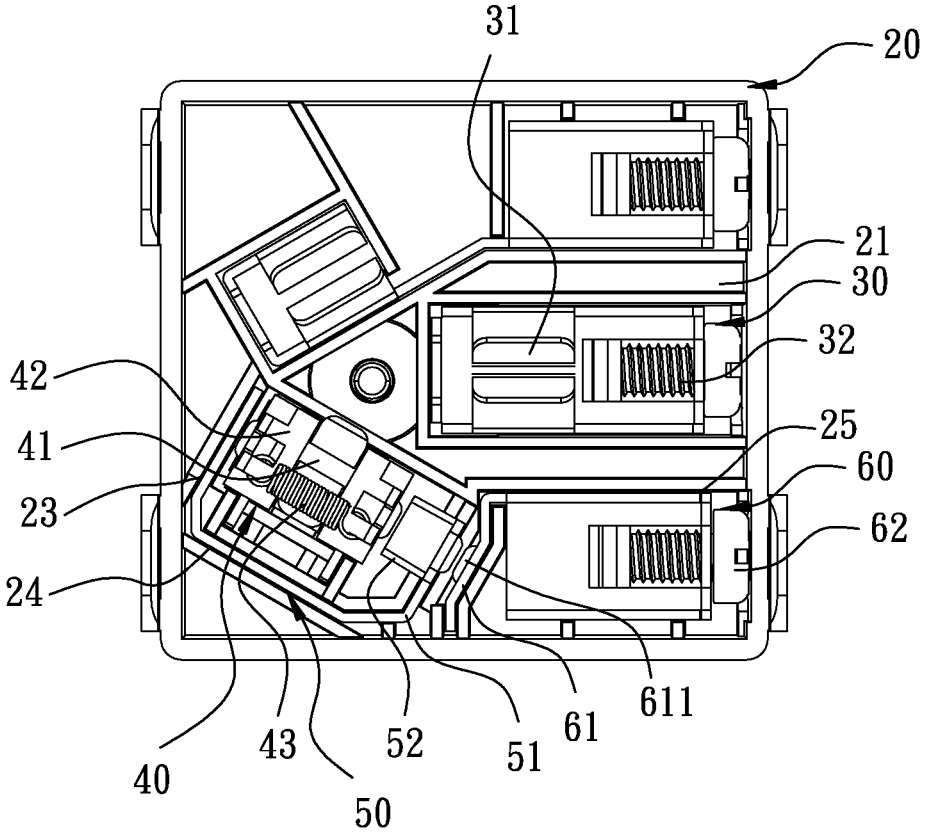
FIG. 3 is a drawing of the box body inner-assembly of the present embodiment.
Figure 4:
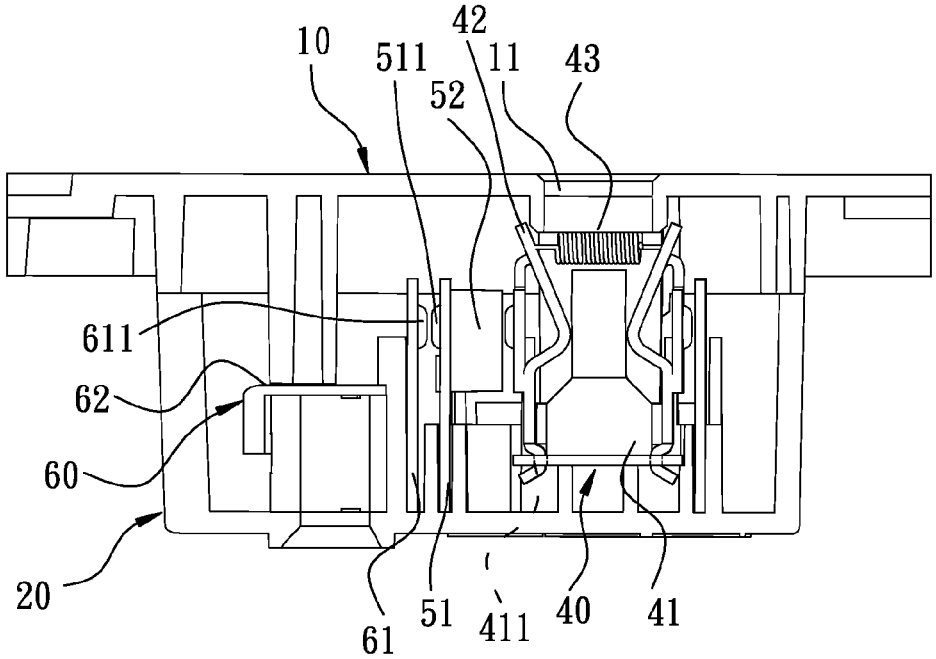
FIG. 4 is a drawing of the present embodiment where the plug is not inserted yet.

In FIGS. 3 and 4, the view of said elastic socket frame (40) assembled within the box body according to the present embodiment and the view wherein the plug is not inserted are given. Said elastic socket frame (40) is stably fixed in said first displacement limiting slot (23). A plug-in slot (41) is found on said elastic socket frame (40), and the jacks (11) of said cover (10) and said plug-in slot (41) match up to each other. A pin hole (411) is passed through the bottom of each side of said plug-in slot (41), and a conductive shrapnel (42) is pivoted on said pin holes (411), and an elastic component (43) is elastically mounted between said conductive shrapnels (42).

Said linkage unit (50) is stably fixed on said second displacement limiting slot (24). Said linkage unit (50) is placed on the side edge of said conductive shrapnel (42). Said linkage unit (50) comprises a connecting conductive shrapnel (51) and a hot melt piece (52). A protruding conductive shrapnel piece (511) extends on one end of said connecting conductive shrapnel (51). The connecting conductive shrapnel (51) is connected to said hot melt piece (52), and said hot melt piece (52) is found at the opposite side of said conductive shrapnel piece (511), and the other side of said hot melt piece (52) may come into contact with said conductive shrapnel (42), and the melting point of said hot melt piece (52) is lower than said connecting conductive shrapnel (51) and the conductive shrapnel (42).

Said wiring terminal frame (60) is stably fixed in said third displacement limiting slot (25). A connection block (61) protrudes from one end of said wiring terminal frame (60). Said connection block (61) is found near the connecting conductive shrapnel (51), and a protruding connection piece (611) extends on said connection block (61) opposite to said conductive shrapnel piece (511). A wiring terminal (62) is positioned at the other end of said wiring terminal frame (60). Said wiring terminal (62) is positioned close to one of the wire guides (22), and said wiring terminal (62) is used to provide connection with a power cable (not shown).

In order to provide better understanding of the present embodiment structure characteristics, its method of use, and expected effects; the way of use of the present embodiment will be described below in more detail. We believe that, with the below given explanations, the present embodiment would be understood thoroughly and concretely.

In FIG. 4, a drawing of the present embodiment is given, where the plug is not inserted yet. Said elastic component (43) can provide an elastic force, which would pull the conductive shrapnels (42) found on both sides inward, so that a new circuit would be opened between said linkage unit (50) and the wiring terminal frame (60) (that is to say, the connecting conductive shrapnel (51) and the conductive shrapnel (42) do not contact with each other).

Figure 5:
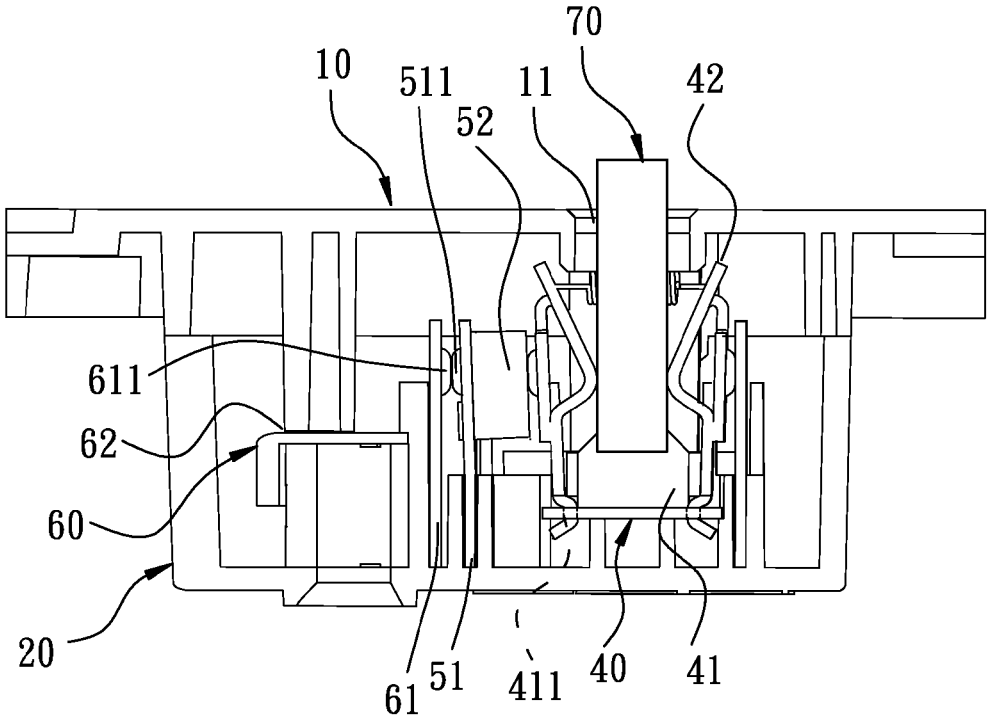
FIG. 5 is a drawing of the present embodiment where the plug is inserted and conducting.

In FIG. 5, a drawing of the present embodiment after the plug is inserted is given. When a plug (70) is inserted into said plug-in slot (41), said plug (70) would push said conductive shrapnels (42) outward, so that the conductive shrapnels (42) that are pivoted on said pin holes (411) move outward under the compression of this force, and at this moment, one of the conductive shrapnels (42) contacts with said connecting conductive shrapnel (51), and the other conductive shrapnel (42) found at the other side pushes said hot melt piece (52), and then, after said connecting conductive shrapnel piece (511) is displaced, it would come into contact with said protruding connection piece (611) and thus conducts electricity.

Figure 6:
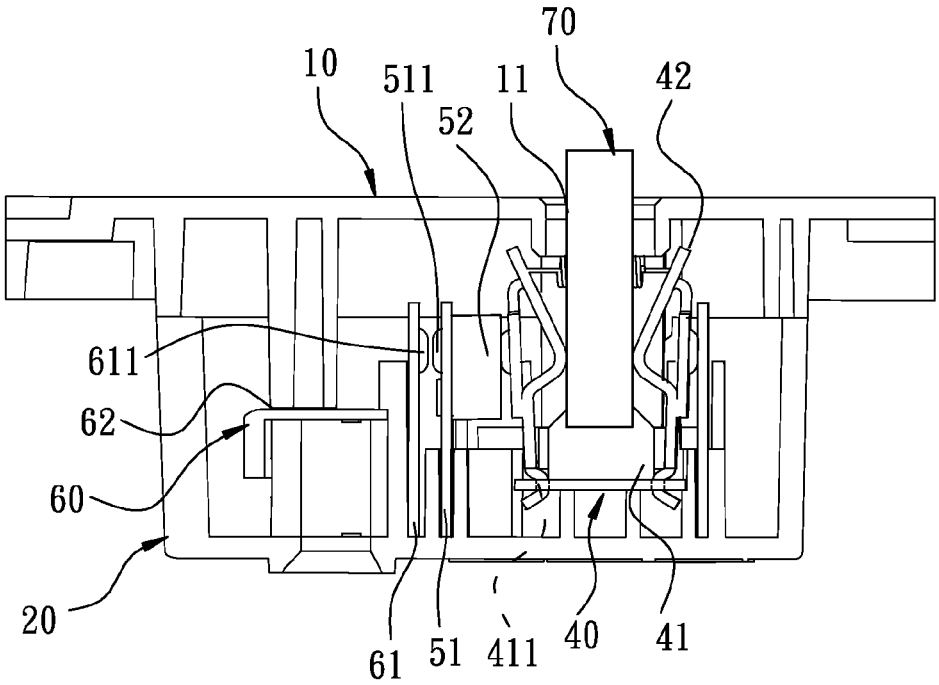
FIG. 6 is a drawing of the present embodiment where the plug is inserted into short circuit.

In FIG. 6, a drawing of the present embodiment is given, where short circuit is formed after the plug is inserted. When the temperature of the connecting conductive shrapnel (51) and the conductive shrapnel (42) rise and exceed the melting temperature of the hot melt piece (52), said hot melt piece (52) would slowly melt and deform, and thus the width of said hot melt piece (52) would gradually narrow down, and then said hot melt piece (52) gradually loses contact with said conductive shrapnel (42). When the contact between said protruding connection piece (611) and the conductive shrapnel piece (511) is lost, or that is to say, a short circuit is formed, said plug (70) can not keep conducting electricity anymore, and as a result, continuous rise of the temperature and the possibility of an accident would be prevented.

The invention claimed is:

1. An overheat auto power off socket, which at least comprises:

a cover, in which a predetermined number of jacks are positioned on said cover;

a box body comprising an open slot, in which the top surface of said open slot can be suitably covered by said cover, and several wire guides pass through the lower side of said open slot;

a socket frame, in which a socket groove that matches up to the jacks provided on said cover is positioned on one end of said socket frame, and a wiring terminal is positioned on the other end, and said wiring terminal is positioned in a way that it would correspond to the position of the wire guide;

an elastic socket frame, in which a plug-in slot is positioned on said elastic socket frame, one of the jacks provided on said cover matches up to said plug-in slot, a conductive shrapnel is positioned on at least one side of said plug-in slot, and said conductive shrapnel would be displaced outward if compressed;

a linkage unit, in which said linkage unit is positioned at one side of said conductive shrapnel, and said linkage unit comprises a connecting conductive shrapnel and a hot melt piece, one side of said hot melt piece is connected to said connecting conductive shrapnel, and the other side of said hot melt piece can come into contact with said conductive shrapnel, and the melting point of said hot melt piece is lower than the melting points of said connecting conductive shrapnel and the conductive shrapnel, and said linkage unit can be pushed by said conductive shrapnel and thus move outward; and a wiring terminal frame, in which a connection block protrudes from one end of said wiring terminal frame, said connection block is found near said connecting conductive shrapnel, and when said connecting conductive shrapnel is compressed and thus displaced, it would come into contact with said connection block, and a wiring terminal is positioned at the other end of said wiring terminal frame, and said wiring terminal is positioned near the position of the wire guide.

2. An overheat auto power off socket according to claim 1, wherein a pin hole is positioned at the bottom of each side of said plug-in slot, said conductive shrapnels are pivoted on said pin holes, and an elastic component is elastically mounted between the tips of said conductive shrapnels.

3. An overheat auto power off socket according to claim 1, wherein a first displacement limiting slot, a second displacement limiting slot, and a third displacement limiting slot are positioned at the bottom of the open slot of said box body, in which said first displacement limiting slot limits the displacement of said elastic socket frame, said second displacement limiting slot limits the displacement of said linkage unit, and said third displacement limiting slot limits the displacement of said wiring terminal frame.

4. An overheat auto power off socket according to claim 1, wherein a protruding conductive shrapnel piece extends on one end of said connecting conductive shrapnel, one end of said hot melt piece is fixed on said conductive shrapnel piece, and a protruding connection piece extends on one end of said connection block opposite to said conductive shrapnel piece.

* * * * *